United States Patent [19]

Hickey

[11] Patent Number: 4,912,829

[45] Date of Patent: Apr. 3, 1990

[54] DRAPERY TIE

[76] Inventor: Donna M. Hickey, 318 Orchard La., Columbus, Ohio 43214

[21] Appl. No.: 307,204

[22] Filed: Feb. 6, 1989

Related U.S. Application Data

[63] Continuation of Ser. No. 133,729, Dec. 16, 1987, abandoned.

[51] Int. Cl.[4] ..... B23P 11/02

[52] U.S. Cl. ..... 29/453; 29/525.1; 24/113 R; 160/349.2

[58] Field of Search ..... 29/525.1, 453, 450, 29/235; 24/113 R, 92; 160/349.1, 349.2; 248/205.1, 217.4, 262, 304, 305, DIG. 12, 558

[56] References Cited

U.S. PATENT DOCUMENTS

| | | | |
|---|---|---|---|
| 153,500 | 7/1874 | Seymour | 24/113 R |
| 176,104 | 4/1876 | Weathers | 24/113 R |
| 223,080 | 12/1879 | Tunstall | 160/349 D |
| 1,831,169 | 11/1931 | Geraldine | 160/349.2 X |
| 2,101,377 | 12/1937 | Weldon | 160/349 D |
| 2,107,885 | 2/1938 | Caggiano | 160/349.2 X |
| 2,210,799 | 8/1940 | Denny | 160/349.2 |
| 2,584,224 | 2/1952 | Pfaffko | 160/349 D |
| 2,993,250 | 7/1961 | Decker | 24/113 R |
| 3,214,811 | 11/1965 | Adinolfi | 24/113 R |
| 3,623,211 | 11/1971 | Zuhlke | 29/448 |
| 3,959,061 | 5/1976 | Renck et al. | 29/453 X |
| 3,997,052 | 12/1976 | Eddy et al. | 29/453 X |
| 4,167,053 | 9/1979 | Ptasinski et al. | 24/113 R |
| 4,559,988 | 12/1985 | Nocerino | 160/349 D |

FOREIGN PATENT DOCUMENTS

| | | | |
|---|---|---|---|
| 354729 | 8/1905 | France | 248/304 |
| 1038451 | 5/1953 | France | 24/113 R |

*Primary Examiner*—Charlie T. Moon
*Attorney, Agent, or Firm*—Bailey & Hardaway

[57] ABSTRACT

A device for tying back drapery can be coordinated with the drapery by affixing a swatch of fabric matching or coordinating with that of the drapery.

2 Claims, 1 Drawing Sheet

FIG. 1
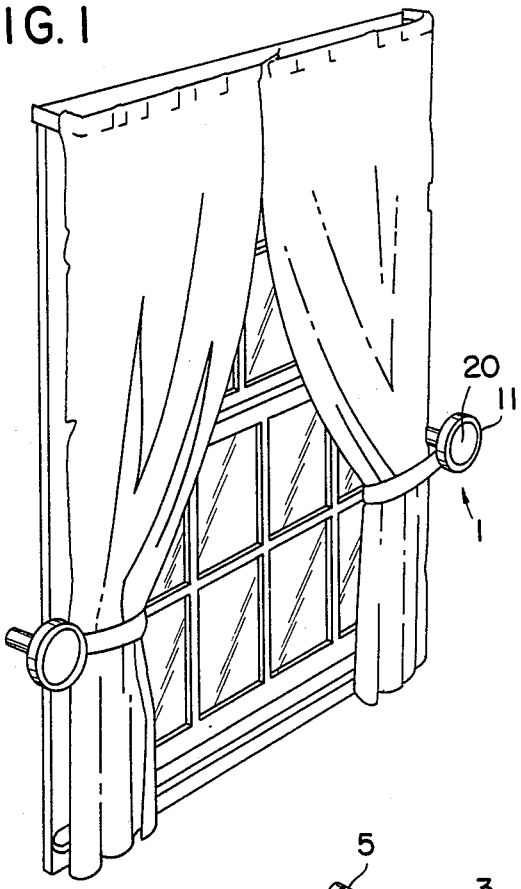
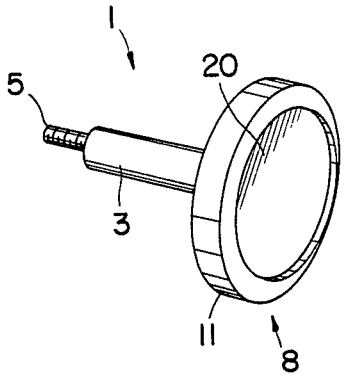
FIG. 2
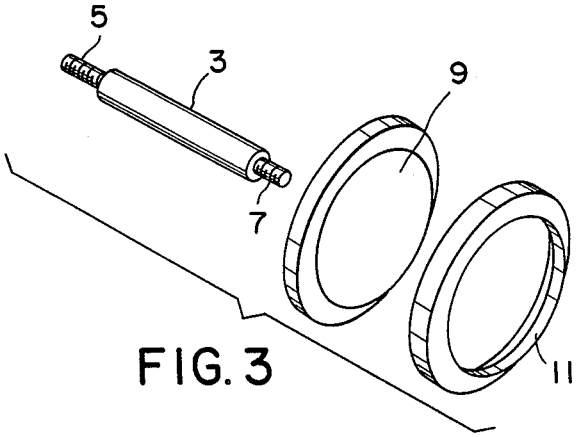
FIG. 3
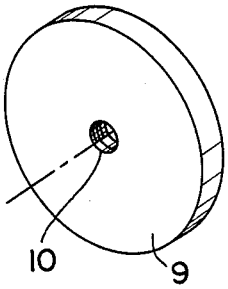
FIG. 4

DRAPERY TIE

This application is a continuation of application Ser. No. 07/133,729, filed 12/16/87 now abandoned.

BACKGROUND OF THE INVENTION

This invention relates generally to the art of tying back draperies and more particularly to a novel, decorative tie back.

It is common in decorating to tie back draperies with a drapery tie of the same fabric as the drapes or of a coordinating fabric. The tie comprised of fabric or cord is conventionally hooked or tied to a tieback mounted on an adjacent wall. While some decorative tiebacks are known, such as that disclosed by McKee in U.S. Des. Pat. No. 163,467, most are of little decorative value. Until now, there have been none which are decorative and easily adaptable for coordination with any color or pattern of drapery, drapery tie or wall covering.

SUMMARY OF THE INVENTION

It is thus an object of this invention to provide a means for tying back draperies.

It is a further and yet more particular object of this invention to provide a means for tying back draperies which is easily adaptable for coordination with any color or pattern of drapery.

These as well as other objects are accomplished by providing a means for holding a drapery tie, means for mounting, and means for carrying a decorative covering.

BRIEF DESCRIPTION OF THE DRAWINGS

FIG. 1 is a front view of the apparatus of this invention in use.

FIG. 2 is a perspective view of the apparatus of this invention.

FIG. 3 is a perspective view of the assembly of the apparatus of this invention.

FIG. 4 is a rear view of the disk of FIG. 1.

DETAILED DESCRIPTION

In accordance with this invention it has been found that the decorative effect of tying back draperies is enhanced by an apparatus which carries a covering which is preferably a swatch of coordinating fabric, which coordinates with the fabric of the drapery, the drapery tie, or even, the wall covering.

FIG. 1 illustrates the apparatus 1 in accordance with this invention carrying a swatch of drapery fabric 20. The apparatus itself is best illustrated in FIG. 2. Preferably means for carrying covering fabric 20 is a clamp ring 11 having a radial flange and an axial flange for snap fittingly securing the fabric to an enlarged end 8.

Means for holding a drapery tie is prefreably stud 3 carrying enlarged end 8. Means for mounting the apparatus 1 is preferably threaded stud bolt or screw 5.

FIG. 3 illustrates the assembly of apparatus 1 in accordance with this invention. Stud 3 carries threaded stud bolts 5 and 7. Enlarged end 8 comprises of a disk 9 and clamp ring 11 is affixed to stud 3 by threaded stud bolt 7. Clamp ring 11 snaps onto disk 9 in the alignment shown.

FIG. 4 shows the rear construction of disk 9 with threaded orifice 10 for accomodation of threaded stud bolt 7. Clamp ring 11 snaps onto disk 9 in the alignment shown. When coordinating fabric is unavailable, disk 9 may be uncovered or may be covered with any other flexible cover such as wallcovering. Fabric or covering may also be applied to stud 3.

It is thus seen that the apparatus of this invention provides a simple decorating means which is easily changed with any change of decor. As various other advantages and features will be apparent to those of skill in the art from a reading of the foregoing description which is exemplary in nature, such variations are included within the spirit and scope of the invention as defined by the following appended claims.

That which is claimed is:

1. In a process wherein wall mounted draperies are installed within a room structure, the improvement comprising:

attaching drapery fabric having a design pattern thereon to a wall structure;.

providing a tieback for said drapery fabric, said tieback comprising a length of fabric providing a tieback fastening means comprising an enlarged end structure, a stud for attaching said enlarged end structure to said wall structure;

a clamp ring having a radial flange and an axial flange for snap fittingly engaging said enlarged end for securing a fabric thereto, said clamp ring radial flange defining an orifice therethrough to display said fabric;

removably securing a covering fabric having a design pattern similar to the fabric design pattern of said drapery between said clamp ring and said enlarged end structure by snap fitting said axial flange of said clamp ring over said covering fabric and onto said enlarged end structure; and attaching said stud to said wall, said tieback and said enlarged end structure.

2. The improvement set forth in claim 1 further including replacing said drapery fabric attached to said wall structure and between said enlarged end and said circular clamp ring so as to display different matching fabrics.

* * * * *